United States Patent [19]

Matsuda

[11] Patent Number: 4,677,011

[45] Date of Patent: Jun. 30, 1987

[54] WARP-KNIT SUPPORT TAPE FOR LOOP AND HOOK FASTENERS

[75] Inventor: Yoshio Matsuda, Toyama, Japan

[73] Assignee: Yoshida Kogyo K. K., Tokyo, Japan

[21] Appl. No.: 927,126

[22] Filed: Nov. 5, 1986

[30] Foreign Application Priority Data

Nov. 15, 1985 [JP] Japan ..... 60-175981

[51] Int. Cl.[4] ..... B32B 3/06; B32B 7/00

[52] U.S. Cl. ..... 428/88; 66/194; 428/92; 428/95; 428/100; 428/230; 428/253; 428/254

[58] Field of Search ..... 428/230, 253, 254, 100, 428/88, 92, 95; 66/194

[56] References Cited

U.S. PATENT DOCUMENTS 4,546,026 10/1985 Kowalski ..... 428/230

*Primary Examiner*—Marion C. McCamish

*Attorney, Agent, or Firm*—Hill, Van Santen, Steadman & Simpson

[57] ABSTRACT

A warp-knit support tape for hook and loop fasteners comprises a pile portion including a foundation of tricot stitches and single cord stitches and a multiplicity of pile-loops formed from chain stitches. The tricot and single cord stitches are formed of crimped yarns, and there is additionally laid in a plurality of warp members made of an elastic material to allow the tape to stretch particularly in its longitudinal direction.

4 Claims, 9 Drawing Figures

WARP-KNIT SUPPORT TAPE FOR LOOP AND HOOK FASTENERS

BACKGROUND OF THE INVENTION

1. Field of the Invention

This invention relates generally to hook and loop fasteners and has particular reference to a stretchable warp-knit loop-carrying support tape engageable with a mating hook-carrying support tape.

2. Description of the Prior Art

Certain prior art tapes for hook and loop fasteners have been proposed that are stretchable in the longitudinal direction. To the knowledge of the present inventor, however, there is no satisfactory prior art which teaches producing economically and efficiently a warp-knit tape which is stretchable longitudinally as desired for application to hook and loop fasteners.

Japanese Patent Publication No. 55-38121 discloses a woven tape for hook and loop fastener which incorporates an elastic yarn to render the tape stretchable as shown in FIG. 6 of the accompanying drawings. Such prior art stretchable tapes are in the form of a relatively narrow strip, and attempts to make stretchable hook and loop fastener tapes of sufficient width from woven material have involved considerable manufacturing problems.

SUMMARY OF THE INVENTION

It is therefore the primary object of the present invention to provide a stretchable support tape for hook and loop fasteners which can be produced highly economically and efficiently.

It is another object of the invention to provide a stretchable support tape which plays the loop part of a hook and loop fastener and which is formed by warp-knitting to increased width.

These and other objects and features of the invention will be better understood from the following detailed description taken in conjunction with the accompanying drawings in which like reference numerals refer to like parts throughout the several views.

According to the present invention, there is provided a warp-knit support tape for hook and loop fasteners which comprises a pile portion constructed with tricot stitches and single cord stitches, both stitches being formed of crimped yarns and chain stitches formed into pile-loops, and warp members of an elastic material laid in warpwise by idle swing.

Figure 1:
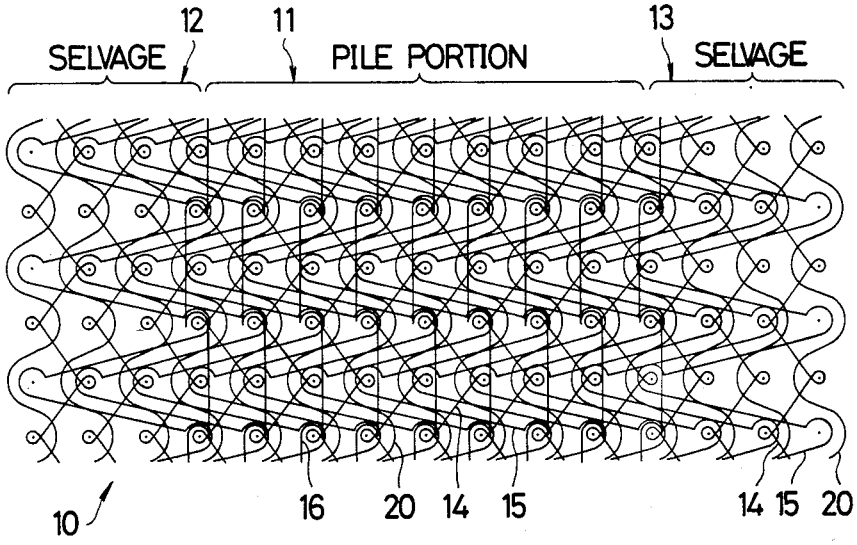
FIG. 1 is a schematic diagram illustrating the construction of a warp-knit support tape embodying the invention.
Figure 2A:
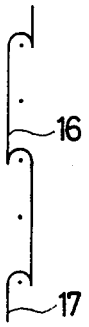
Figure 2B:
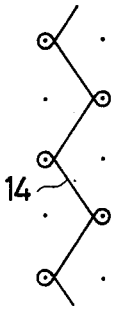
Figure 2C:
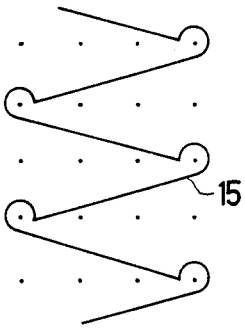
Figure 2D:
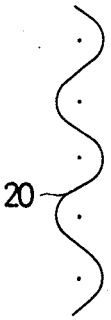
Figure 3:
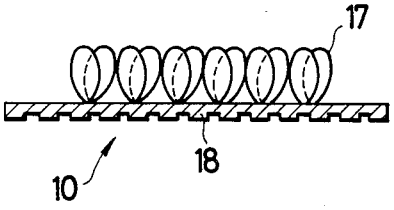
Figure 4:
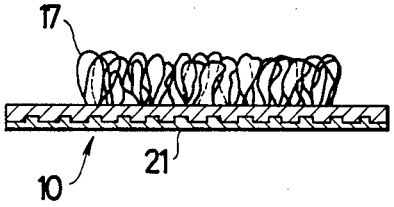
Figure 5:
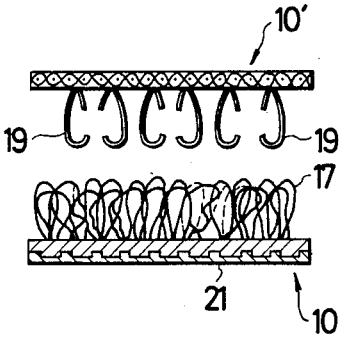
Figure 6:
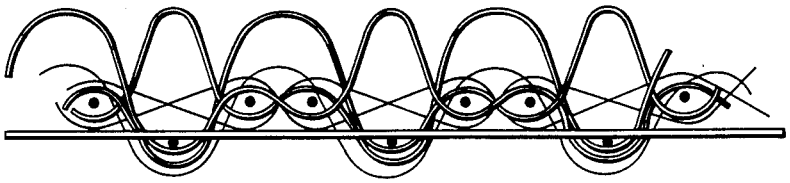
FIG. 6 PRIOR ART

FIGS. *2a–2d* inclusive are diagrammatic representations of the various stitches incorporated in the support tape of FIG. 1;

FIG. 3 is a cross-sectional view of the support tape of FIG. 1;

FIG. 4 is a view similar to FIG. 3 but showing the tape after being treated;

FIG. 5 is a view similar to FIG. 4 but showing the tape in confronting relation to its mating hook part of a hook and loop fastener; and FIG. 6 is a schematic representation on enlarged scale of a prior art woven support tape for hook and loop fasteners.

DETAILED DESCRIPTION

In FIG. 1, there is shown a preferred form of a warp-knit support tape 10 to be used as a loop or female part of a hook and loop fastener. The support tape 10 consists of a pile portion 11 and selvage portions 12 and 13 extending warpwise on opposite sides of the pile portion 11.

The pile portion 11 of the tape 10 is constructed with tricot stitches 14, single cord stitches 15, both stitches being interlaced to make up a foundation of the tape 10, and chain stitches 16 which form a multiplicity of pile-loops 17. For the tape 10 to be stretchable, the tricot stitches 14 and the single cord stitches 15 are crimped by suitable treatment.

The tricot stitches 14 are of Link No. 1-2/1-0/1-2/1-0 or 2-3/1-0/2-3/1-0, and the single cord stitches 15 are of Link No. 0-1/4-3/0-1/4-3, as shown in FIGS. *2b* and *2c*, respectively.

The chain stitch 16 is of an open lap and represented by Link No. 1-0/0-0/0-1/1-1 or 1-0/0-0/0-0/0-1/1-1/1-1, as shown in FIG. *2a*, and threads therefor are positively overfed beyond the normal rate of feed of threads for the remaining stitches and formed by sinker looping into pile-loops 17 extending over every other course. The pile-loops 17 are arranged to extend longitudinally of the tape 10 alternately along the right and left sides of wales 18 as shown in FIG. 3, whereby increased opportunity is provided for the loops 17 to engage the hooks 19 on the mating tape as shown in FIG. 5.

The chain stitches 16 forming the pile-loops 17 are made of multifilamentary threads which may be also crimped.

Designated at 20 is a warp member made of a covered yarn such as synthetic rubber yarn, Spandex yarn or other elastic yarn which is laid in by idle swing and has Link No. 0-0/1-1/0-0/1-1 or 0-0/2-2/0-0/2-2 as shown in FIG. *2d*. The warp member 20 is knitted in place while being stretched and is allowed to shrink when removed from the knitting machine, and it may be laid in over each wale or over every other or more wales depending upon the construction and extent of stretch of the tape 10 desired.

The selvages 12 and 13 extend over three wales 18 on opposite sides of the tape 10 as shown in FIG. 1 and are constructed with the same knit threads as the pile portion 11 except for the absence of pile-loops 17. The inclusion of warp members 20 enhances stretchability of the tape 10 particularly in the longitudinal direction which is preferrably from 1.5 to 2 times.

FIG. 4 shows the loop-carrying or female support tape 10 after being finished. This finishing treatment includes heat-setting, dying, brushing and coating. Brushing is done to comb up and separate the pile-loop 17 into filamentary condition so as to facilitate their engagement with the hooks 19 on the male support tape 10' as shown in FIG. 5.

The tape 10 is coated on its underside with a suitable elastic material 21 to anchor the pile-loops 17 in place against dislocation from the web of the tape 10, the elastic material 21 being silicone rubber, polyurethane foam, other elastic rubber or resin materials.

As will appear apparent to one skilled in the art, the tape 10 is sewn or otherwise attached along the selvages 12 and 13 onto a garment article.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A warp-knit support tape for hook and loop fasteners which comprises a pile portion constructed with tricot stitches and single cord stitches, both stitches being formed of crimped yarns and chain stitches formed into pile-loops, and warp members of an elastic material laid in warpwise by idle swing.

2. A warp-knit support tape according to claim 1, wherein said tape is coated on its underside with an elastic coating.

3. A warp-knit support tape according to claim 1, wherein said chain stitches are formed of multifilamentary yarns.

4. A warp-knit support tape according to claim 1, said tape is finished by brushing to comb up and separate said pile-loops into filamentary condition.

* * * * *